US005977042A

United States Patent [19]

Hernandez et al.

[11] Patent Number: 5,977,042

[45] Date of Patent: Nov. 2, 1999

[54] CONCENTRATED STRIPPER COMPOSITION AND METHOD

[75] Inventors: Paul M. Hernandez, County of Lake, Ill.; Lance D. Brown, County of Racine, Wis.

[73] Assignee: S. C. Johnson Commercial Markets, Inc., Sturtevant, Wis.

[21] Appl. No.: 09/164,748

[22] Filed: Oct. 1, 1998

[51] Int. Cl.[6] ..... C11D 3/44; C11D 1/04; C11D 3/30

[52] U.S. Cl. ..... 510/201; 510/217; 510/245; 510/365; 510/214; 510/201; 510/203; 510/206; 510/212; 510/207; 510/499; 510/505; 510/506; 510/488

[58] Field of Search ..... 510/214, 217, 510/245, 365, 201, 203, 206, 212, 207, 499, 505, 506, 488

[56] References Cited

U.S. PATENT DOCUMENTS

| | | | |
|---|---|---|---|
| 4,414,128 | 11/1983 | Goffinet | 510/405 |
| 4,749,509 | 6/1988 | Kacher | 510/427 |
| 5,080,822 | 1/1992 | VanEenam | 510/365 |
| 5,080,831 | 1/1992 | VanEenam | 510/365 |
| 5,158,710 | 10/1992 | VanEenam | 510/264 |
| 5,411,678 | 5/1995 | Sim | 510/206 |
| 5,454,985 | 10/1995 | Harbin | 510/206 |
| 5,543,073 | 8/1996 | Adamy et al. | 510/417 |
| 5,636,559 | 6/1997 | Koreltz | 510/201 |

FOREIGN PATENT DOCUMENTS

| | | |
|---|---|---|
| 9689885 | 3/1996 | Japan . |
| WO 97/32937 | 9/1997 | Japan . |

*Primary Examiner*—Ardith Hertzog
*Assistant Examiner*—Dawn L Garrett
*Attorney, Agent, or Firm*—S. C. Johnson Commercial Markets, Inc.

[57] ABSTRACT

The present invention is directed to a composition for stripping coatings from a surface, the composition including:

a. A solvent mixture composed of a phenyl substituted alkyl alcohol and an alkyl or aryl glycol ether or an alkyl or aromatic alcohol;

b. A coupler composed of a salt formed from a water soluble organic amine and an acid comprising at least one C7–C18 ethoxylated anionic surfactant;

c. Optionally water.

The use of the C7–C18 ethoxylated anionic surfactant provides a stripper which can be diluted in water of various compositions yet provide an effective stripping/cleaning agent.

5 Claims, No Drawings

CONCENTRATED STRIPPER COMPOSITION AND METHOD

BACKGROUND OF THE INVENTION

Technical Field

This invention relates to compositions and methods of using compositions to strip or remove coatings such as typical floor finishes and cleaning of such surfaces. More particularly, it relates to a stripping composition which can be diluted and still provide efficient stripping.

Background Art

There are available numerous concentrated stripper and cleaner/degreaser formulations for use in conjunction with floors. U.S. Pat. No. 5,637,559 from 3M discloses a floor stripping composition which includes a phenyl substituted alkyl alcohol which preferably is benzyl alcohol having a water solubility of at least 0.1 weight percent, a coupler consisting of a fatty acid of C8 in chain length and water. The coupler is at least 3.0 times the amount necessary to completely solubilize the phenyl substituted alkyl alcohol in the water. Preferred couplers are the salt of a monofunctional water-soluble amine and an organic acid comprising at least one water-insoluble organic acid having from 6–10 carbon atoms. U.S. Pat. Nos. 5,080,831; 5,080,822 and 5,158,710 from Buckeye International, Inc. teach the use of sparingly water soluble solvents when used with a hydrotrope to form a aqueous solution or microemulsion that can used as a stripper. The solvents, such as benzyl alcohol, cited in these patents have a water solubility ranging from 0.2 to approximately 6 weight percent in water. In the '831 patent the solubilizing agent is present in an amount not exceeding approximately twofold that required to completely solubilize the organic solvent. Japanese Patent JP 9689885 assigned to S. C. Johnson Inc. teaches the use of a phenyl substituted alkyl alcohol having a water solubility of at least 0.1 weight percent. Benzyl alcohol is also disclosed with Tall Oil Fatty Acid as the organic acid which when combined with a monofunctional water-soluble amine as the coupler form an aqueous floor finish stripper.

Other cleaning compositions with a specific solvent or surface active agent are described in U.S. Pat. Nos. 4,749,509 and 5,543,073.

SUMMARY OF THE INVENTION

Contrary to the teachings of the art, the inventors have discovered that compositions containing at least two specific solvents from the select class of slightly water-soluble organic solvents and a specific coupler, wherein the coupler is present at greater than 2.0 times that required to completely solubilize the solvent are much more efficient in removing a variety of floor finishes at higher dilutions than prior art compositions. The other unique property of the inventive composition is the ability to remove these floor finishes of higher dilutions than the prior art compositions and the ability to remain stable in the concentrate as well as in dilution. Another surprising attribute that has been uncovered is the ability of these compositions to be diluted in hard water and still being stable and effacaeous. The use of a new coupling agent has also given these compositions the ability to be prepared using alkaline salts such as NaOH and KOH and still be stable in the concentrate as well as in dilution which the prior art compositions are not. The use of a new coupler has also the added feature of being less viscous and therefore is easier to be diluted via dispensing equipment and other typical dilution methods.

The objects of the invention therefore are:

a. Providing an improved floor coating stripper composition.

b. Providing an improved stripper composition of the foregoing kind which is compatible with water of various compositions.

c. Providing an improved stripper composition of the foregoing kind which can be diluted in the 1:30–1:50 range and still be effective.

d. Providing an improved stripper of the foregoing kind which can be dispensed with automated dispensing systems.

The foregoing objects are accomplished and the shortcomings of the prior art are accomplished by the compositions of this invention which are suitable for stripping of various floor finish coatings, such as acrylic, urethane and epoxy polymer base, from a variety of surfaces, such as vinyl composition, terrazzo, marble, linoleum, concrete and the like as well as an effective cleaner/degreaser after being diluted with water from 1 part of said compositions to 50 parts of water and still remove the finish. In one embodiment, the compositions may be formulated comprising:

a. About 1–55% by weight of a solvent mixture composed of a phenyl substituted alkyl alcohol and about an equal amount of an alkyl or aryl glycol ether or an alkyl or aromatic alcohol, the solvent mixture effective in removing at least 20% of a standard acrylic floor sealer/finish from a composition vinyl tile in fewer than 2.5 minutes;

b. a coupler composed of a salt formed from a water soluble organic amine and an acid comprising at least one C7–C18 ethoxylated anionic surfactant, the coupler and the solvent mixture present in a weight ratio of about 1:1.2 to about 1:2.0 wherein the amount of the coupler is at least 2.0 times the amount necessary to completely solubilize the solvent mixture; and c. optionally water.

In another embodiment, the water-soluble organic amine is monoethanolamine or a combination of monoethanolamine and potassium hydroxide.

In yet another embodiment, the acid is a C9–C11 ethoxylated anionic surfactant and has 4 moles of ethoxylation.

In still another embodiment, the phenyl substituted alkyl alcohol is benzyl alcohol, and the alkyl glycol ether is ethylene glycol monohexyl ether.

In yet another embodiment, the coupler includes tall oil.

"Diluted with water" as used herein means the inventive compositions are reduced in actives concentration by adding from 0.1 part of 100 parts of water per part of inventive composition. Specific dilution ratio are dependent on the end use, as shown in the following Examples. Additionally the water hardness described is from 0 ppm to 450 ppm hardness as $CaCO_3$.

"Effective amount" when referring to the solvent blend of phenyl substituted alkyl alcohol and alkyl glycol ether means that is present in an amount which removes at least 20 percent of a standard urethane/acrylic floor finish from a composition vinyl tile within fewer than 2.5 minutes, in accordance with a standard test (see Test Methods section).

As used herein the term "coupler" refers to a compound or a physical or chemical combination of compounds having the capability of increasing the phase-stability of the compositions of the invention. The couplers that are preferred comprise low molecular weight (molecular weights in the 300 to 800 range) organic monoethanolamine and alkaline salts either sodium hydroxide or potassium hydroxide with organic acid (tall oil) and ethoxylated carboxylic acid (C9–C11 carboxylic acid with 4 moles of ethoxylation; trade name of Neodox 1–4).

The compositions can also include an effective amount of chelating agents (e.g. ethylene diaminietriacetic acid) and other surfactants for added stability and enhanced hard water stability but are not crucial to this invention. Water soluble solvents such as ethylene glycol monobutyl ether can also be used with this invention to enhance cleaning and stripping ability.

The compositions of the invention are substantially more effective in removing multiple/difficult to remove floor sealer/finishes comprising of urethane/acrylic polymers than the previously described patented compositions, as shown in the Examples.

Another aspect of the invention is a method of removing a sealer/finish coating from a surface, the method comprising:

a. applying to the coating a composition within the invention; and b. allowing the composition to contact the coating for a time sufficient to at least partially remove the coating. As used herein "coating" is meant to include a single layer or multiple layers of the same composition and coatings comprising two or more layers, each layer comprising of dissimilar compositions.

Preferred methods comprise of abrading the coating after a predetermined contact time between the coating and the composition, such as with an open three dimensional non-woven pad which is attached to a conventional floor maintenance machine.

Alternatively, the composition may be applied and removed using other natural and synthetic fiber-based cloth.

Further aspects and advantages of the invention will become apparent from the description of the preferred embodiments which follows.

DESCRIPTION OF PREFERRED EMBODIMENTS

The compositions of the present invention are especially useful in stripping a variety of difficult to strip "sealer/finishes" from flooring materials such as composition vinyl tiles, linoleum, marble, terrazzo, concrete and the like. The compositions of the invention may also be employed in degreasing grease, oil, cooking oils and the like from a variety of floors in restaurants, homes, automobile shops and the like. The compositions of the invention may also be employed in cleaning a variety of other surfaces other than floors. The various ingredients are discussed in more detail.

Phenyl Substituted Alkyl Alcohols

Phenyl substituted alkyl alcohols are the first solvents and function as the coating dissolver and/or grease solubilizing component of the compositions of the invention. The phenyl substituted alkyl alcohols are from the class of "sparingly" or "slightly" water soluble organic solvents which have water solubility of at least 0.1 weight percent, more preferable ranging from about 0.2 to about 6 weight percent. Phenyl substituted alkyl alcohols useful in the invention include benzyl alcohol, alpha-phenylethyl alcohol, betaphenylethyl alcohol, ethylene glycol phenyl ether, and the like. One of the preferred phenyl substituted alkyl alcohols which is slightly water-soluble is benzyl alcohol.

The second solvent used in the invention is from the alkyl glycol ether family and it functions in that it increases the wetting as well as the dissolving ability of the benzyl alcohol. The preferred secondary solvent is ethylene glycol hexyl ether (Trade name Hexyl Cellosolve) and it too is a "sparing soluble" solvent with similar properties of low toxicity, availability, relative nonhazardous to transport with a essentially a non-odor as benzyl alcohol.

The term "alkyl" as used herein means an alkyl group having 1–10 carbon atoms.

In addition to the water solubility criteria mentioned previously, it is also desirable but not essential that the phenyl substituted alkyl alcohols and the alkyl glycol ether employed in the invention have a relatively low volatility or high flash point (in excess of 60 C.) exhibit a low level of odor, be chemically stable, non-toxic, nonhazardous and commercially available.

We have found the use of phenyl substituted alkyl alcohol in conjunction with the use of alkyl or aryl glycol ether or an alkyl or aromatic alcohol in equal proportions in the composition as having unexpected results not found by the use of either one individually. This solvent mix is in an amount sufficient to remove the coating to which it is applied, the amount varying with the coating or residue to be removed. Further compositions within the invention preferably have the following weight ratios of active ingredients:

Phenyl substituted alkyl alcohol to coupler, from 1:1 to 1:2.0. Preferably 1:1.6.

Alkyl glycol ether to coupler, from 1:1 to 1:2.0. Preferably 1:16.

Phenyl substituted alkyl alcohol to anionic surfactant from 1:10. Preferably 1:1.5.

Alkyl glycol ether to anionic surfactant from 1:10. Preferably 1:5.5.

For particularly hard to remove coatings the weight percentage of phenyl substituted alkyl alcohols/alkyl glycol ethers in the ready-to-use composition may be as high as 10 weight percent. For easier to strip finishes or cleaning, one may dilute the concentrates so that the weight percentage of phenyl substituted alkyl alcohols/alkyl glycol ethers is as low as 0.5 weight percent. A preferred ready-to-use composition includes from 1.0 to 3.5 wt % of solvent. These concentrations of solvent combinations may be diluted as the concentrates listed in Table 1. For cleaning compositions the solvent mixture will have the power to remove greasy residues at less than 1 weight percent.

The following Table 1 illustrates two of the preferred compositions of this invention.

TABLE 1

| Ingredient | Concentrate 1 | Concentrate 2 |
|---|---|---|
| Benzyl alcohol | 27.5 | 27.5 |
| Hexyl Cellosolve | 27.5 | 27.5 |
| Monoethanolamine | 35.0 | 17.0 |
| Tall Oil Fatty acid | 5.0 | |
| Neodox 1-4 | 5.0 | 10.0 |
| Potassium hydroxide | — | 18.0 |

Couplers

Couplers function to increase the phase stability of the composition by increasing the apparent water solubility of the solvent mix. Suitable couplers for use in the compositions of the present invention include the salt of a low molecular weight monofunctional amine as well as alkaline salts such as sodium hydroxide and potassium hydroxide as well as organic acid. These couplers allow the use of high concentration of solvent coupled/emulsified and are instrumental in the stability of the product as well as stability of the diluted product. Particularly preferred monofunctional amines include water soluble organic amines such as monoethanolamine (MEA), 2-aminomethylprpanol (AMPS), and other n-alkyl substituted derivatives of these.

Preferred acids include fatty acids (tall oil) as well as C7–C18 carboxylic acids with ethoxylation of 1–10 moles of ethylene oxide. For this invention tall oil and the carboxylate Neodox 1–4 available from Shell Chemical Co. is especially preferred. We have also found that by the inclusion of the ethoxylated organic acid that that it not only improves product stability but enhances the stability of the concentrate when diluted in hard water so that no additional builder or chelate is necessary. Another key attribute found with the unique use of alkaline salts like sodium hydroxide and potassium hydroxide. We have also found that by the use of these carboxylic acids combinations we obtained less viscous compositions which are much easier dispensed from venturi type dispenser than prior art compositions.

The couplers are present in ready-to-use compositions of the invention such that the amount of the coupler is always less than or equal to the solvent blend used. This a departure from previous taught patents where said coupler are either equal to or as much as 3.0 times necessary to solubilize the solvents in water.

Other optional surfactants that can be used in this invention are nonionics, in particular the Tergitols, such as Tergitol 15-S-9, which has been found to be useful in making formulations not containing ethoxylated carboxylates, however they are not the preferred surfactants. Tergitol is a trademark of Union Carbide Corporation for C8–C18 nonionic surfactants with 1–15 moles of ethylene oxide. Other anionic surfactants that have found utility are the well known hydrotropes like sodium xylene sulfonate as well as the following: dodecylbenzene sulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyl diphenyloxide disulfonate, sodium hexadecyloxypoly (ethyleneoxy) (10) ethyl sulfonate, potassium octylphenoxypoly (ethyleneoxy) (9) ethyl sulfonate, sodium alpha $C_{12-14}$ olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly (ethyleneoxy) (4) sulfate, sodium diisobutylsulfosuccinate, disodium laurylsulfosuccinate, tetrasodium N-laurylsulfosuccinimate, sodium mono decyloxypoly (ethyleneoxy) (4) phosphate, sodium di decyloxypoly (ethyleneoxy) (6) phosphate, and postassium mono/di-octylphenoxypoly (ethyleneoxy) (9) phosphate. These surfactants and hydrotropes were found to be especially useful in formulating other compositions that contained water soluble solvents like butyl Cellosolve.

These compositions can also be thickened and used for various other applications especially for vertical surfaces and as an aerosol applications. Prior art describes the use of specific ingredients that are useful for those applications.

In the methods of the invention, the compositions of the invention may be applied with a mop, poured onto the surface to be cleaned or stripped as well as dispensed from a suitable dispenser such as one of the venture type (J-Fill dispenser). The compositions may also be applied by conventional floor maintenance machines, or they may be sprayed as an aerosol or non-aerosol upon the surface to be cleaned. Spraying can be accomplished by conventional mechanical spraying devices or by using an aerosol dispensing container with a sufficient amount of suitable aerosol propellant, for example, low boiling alkanes or mixtures thereof, such as a mixture of isobutane and propane.

Further application of the compositions and methods of the invention will be understood with reference to the following Examples wherein all parts and percentages are by weight unless otherwise specified. These Examples are set forth to illustrate the invention and are not intended to limit the invention in any way.

EXAMPLES

The concentrated compositions shown in Table 1 above were diluted with water at the dilutions indicated in Table 2 to formulate the compositions of Examples 1–2. Table 2 also shows additional formulations and the various key compositions tested to arrive at the compositions of this invention. The compositions of comparative Examples A–C in Table 3 were formulated in accordance with the teaching of U.S. Pat. No. 5,158,710; U.S. Pat. No. 5,637,559 and Japanese Patent 9689885 and are provided in prior art Examples A–C.

The composition of Examples 1–7 and Comparative Examples A–C were tested to determine their proficiency in removing 10 coats of a commercially available acrylic finishes from a composition vinyl tile strip, the finish available from SC Johnson Professional, Racine, Wis. under the trade designation of Signature. To clean previously stripped tiles 10 coats of finish was applied. After each coat a crayon marker was used to identify each coat. The Signature coated tiles were burnished (high speed burnisher) after 3, 6 and 10th coat prior to oven aging in order to enhance and duplicate actual aged coatings found in commerce. After all 10 coats were applied the tiles were aged in a oven at 125 F. for 100 hours to allow the coating to fully harden and thus simulate aged coating.

The compositions of Examples 1–7 as well as Comparative Examples A–C were then tested via the use of a Gardner Scrubber by placing strips of tiles treated and identified onto the bed of the Scrubber. Each strip of tile was stripped with a red non-woven nylon pad which was attached to a pulley and is dragged over the tile to simulate the type of abrasion done in actual practice. To each strip of tile 15 mls of diluted concentrated stripper solutions were applied to the tile. Immediately after the solution was applied the Gardner Scrubber was started and number of coats removed versus cycles was recorded. In all Examples, the number of maximum cycles used was 100 cycles or less depending on complete removal.

As a second method to determine stability of both the concentrate as well as dilution, comparative as well as compositions were tested via two methods. The first method for composition stability was to make up the composition and subject it to both 40 F. and 125 F. in a refrigerator or oven for at least 3 days. The results are also included. A second test which determined the stability of the diluted product was done by diluting the concentrates in synthetic 300 ppm hard water (as CaCO3). The results from this test is also indicated in the Tables. These tests are used by those skilled in the art of developing compositions and are readily accepted as an indication of the overall micro-emulsion properties and efficiency of the surfactants/solvents used.

The third test run was viscosity at 44 F. which gives a good indication of the rheology of the composition and is crucial in dispensing from venturi type dispenser (J-Fill), The lower the viscosity the more accurate the dilutions which are critical in performance. Viscosities greater than 50 cps can be used but viscosities less than 40 cps are preferred.

TABLE 2

| Ingredient | Ex. 1 | Ex. 2 | Ex. 3 | Ex. 4 | Ex. 5 | Ex. 6 | Ex. 7 |
|---|---|---|---|---|---|---|---|
| Monoethanol Amine | 35 | 17 | 35.0 | 35 | 35 | 35 | 35 |
| Benzyl Alcohol | 27.5 | 27.5 | 27.5 | 13.75 | 41.25 | | |
| Hexyl Cellosolve | 27.5 | 27.5 | 27.5 | 41.25 | 13.75 | 27.5 | 27.5 |
| 1-Butoxy Propanol | | | | | | 27.5 | |
| Ethylene Glycol Phenyl Ether | | | | | | | 27.5 |
| Tall Oil Fatty Acid | 5.0 | | 5.0 | 10.0 | 10.0 | 5.0 | |
| Tergitol 15-S-9 | | | 5.0 | | | | |
| Neodox 1-4 | 5.0 | 10.0 | | | | | |
| Neodox 45-6 | | | | | | 5.0 | 5.0 |
| Potassium Hydroxide | | 18.0 | | | | | |
| No. of coats Signature Removed Dilution | | | | | | | |
| @1:15 | 9 | 10 | 8 | | | | |
| @1:25 | 8 | 8 | 6 | | | | |
| Dilution Stability-Conc. | pass* | pass | pass | sep* | sep | sep | sep |
| @1:15 (hard water) | pass | pass | pass | sep | sep | | |
| @1:25 (hard water) | pass | pass | pass | | | | |
| @1:256 (hard water) | pass | pass | pass | | | | |
| Viscosity @44 F (cps) | 44.8 | 76.8 | 44.8 | | | | |

Pass-refers to solution/emulsion is stable for 24 hours
Sep. refers to separation or precipitation after dilution

PRIOR ART EXAMPLES

| Ingredient | %/Wt |
|---|---|
| Example A - 3M Formulation | |
| Monoethanolamine | 33.9 |
| Benzyl Alcohol | 39.9 |
| n-Octanoic Acid | 25.0 |
| FC-135 | 0.20 |
| Dye | 0.50 |
| Chelating Agent | 0.50 |
| Example B - Butchers Full Impact | |
| Monoethanolamine | 23.2 |
| Benzyl Alcohol | 47.9 |
| Dipropylene Glycol n-Butyl Ether | 13.5 (water soluble solvent) |
| Tall Oil FA Salt (Amine) | 15.4 |
| Example C - Japan Power - Go | |
| Monoethanolamine | 18.0 |
| N-($_1$B Aminoethyl) Ethanolamine | 15.0 |
| Benzyl Alcohol | 35.0 |
| Tall Oil Fatty Acid | 5.0 |
| Fluoroalcohol Phosphate and Eto Quatermonium Salt | 0.1 |
| Perfluoro Alky Phosphate (15%) Fluorinated Acrylic Ester Copolymer (20%) | 0.6 |
| Water | 0.1 |
| | 26.2 |

TABLE 3

| | Comparative Examples A–C | | |
|---|---|---|---|
| 3M Formulation | A | | |
| Butchers Full Impact | | B | |
| Japan Power-Go | | | C |

TABLE 3-continued

| | Comparative Examples A–C | | |
|---|---|---|---|
| No. of coats Signature Removed Dilution | | | |
| @1:15 | 7 | 8 | 7 |
| @1:25 | 6 | 7 | 3 |
| Dilution Stability -Conc | pass | pass | pass |
| @1:15 (hard water) | pcpt | pcpt | pcpt |
| @1:25 (hard water) | pcpt | pcpt | pcpt |
| @1:256 (hard water) | pcpt | pcpt | pcpt |
| Viscosity @44F (cps) | 102.4 | 25.6 | 27.0 |

Pcpt-refers to substantial precipitation when concentrate is diluted.

These Examples A–C as well as Examples 1–7 illustrate the importance of the ethoxylated anionic surfactant coupler if it is to be diluted and still act as an effective stripper.

While certain alkyl and aryl ethers as well as alkyl alcohols have been indicated for use with the phenyl substituted alkyl alcohols of this invention, other alkyl and aryl ethers as well as alkyl and aromatic alcohols can be employed which are described as follows according to their water solubility.

| WATER SOLUBLE: >6.0 Wt. Percent soluble in water | |
|---|---|
| Ethylene Glycol Monobutyl Ether | Triethylene Glycol n-Butyl Ether |
| Propylene Glycol methyl ether | Diethylene Glycol Methyl Ether |
| 2-Tertiary Butoxy Ethanol | Triethylene Glycol Methyl Ether |
| Dipropylene Glycol Methyl Ether | Ethylene Glycol Monopropyl Ether |
| Tripropylene Glycol Methyl Ether | Diethylene Glycol Monomethyl Ether |
| Propylene Glycol n-Propyl Ether | Methoxytriglycol |
| Dipropylene Glycol n-Propyl Ether | Ethoxytriglycol |
| Diethylene Glycol n-Butyl Ether | |
| Butoxytriglycol | |

| SPARINGLY WATER SOLUBLE: <6.0 Wt. Percent soluble in water | |
|---|---|
| 1-phenoxy-2-propanol | Cyclohexanol |
| Propylene Glycol n-Butyl Ether | iso-octanol |
| Dipropylene Glycol n-Butyl Ether | Texanol (Eastman) |
| Tripropylene Glycol n-Butyl Ether | n-decanol |
| Propylene Glycol Phenyl Ether | Diethylene Glycol mono hexyl Ether |
| 2-Octanol | 2-Ethyl Hexanol |

INDUSTRIAL APPLICABILITY

The compositions of this invention are useful in stripping and removing coatings such as floor finishes as well as the cleaning of such surfaces. They can be diluted with water and still provide stripping and cleaning properties.

What is claimed is:

1. A composition suitable for stripping coatings from a surface the composition comprising:

a. 1–55% by weight of a solvent mixture composed of benzyl alcohol and about an equal amount by weight of an alkyl or aryl glycol ether or an alkyl or aromatic alcohol, said solvent mixture effective in removing at least 20% of a standard acrylic floor sealer/finish from a composition vinyl tile in fewer than 2.5 minutes;

b. a coupler composed of a salt formed from a water soluble organic amine and an acid comprising at least one C7–C18 ethoxylated anionic surfactant, said coupler and said solvent mixture present in weight ratio of solvent mixture present in a weight ratio of 1:1.2 to 1:2.0 wherein the amount of the coupler is at least 2 times the amount necessary to completely solubilize the solvent mixture; and c. optionally water; wherein the water-soluble organic amine is monoethanolamine or a combination of monoethanolamine and potassium hydroxide.

2. Composition in accordance with claim 1 wherein the acid has 4 moles of ethoxylation.

3. The Composition in accordance with claim 1 wherein the coupler further includes tall oil.

4. Composition in accordance with the claim 1 wherein the solvent mixture has a water solubility of at least 0.1 weight percent.

5. A method of removing a coating from a surface comprising:

applying to the coating the composition of claim 1; and allowing the composition to contact the coating for a time sufficient to at least partially remove the coating.

* * * * *

UNITED STATES PATENT AND TRADEMARK OFFICE

CERTIFICATE OF CORRECTION

PATENT NO. : 5,977,042

DATED : November 2, 1999

INVENTOR(S) : Paul M. Hernandez, et al.

It is certified that error appears in the above-identified patent and that said Letters Patent is hereby corrected as shown below:

On title page, item 56 U.S. PATENT DOCUMENTS
replace "5,636,559"
with --5,637,559--.

Signed and Sealed this

Fifth Day of September, 2000

*Attest:*

Q. TODD DICKINSON

*Attesting Officer*

*Director of Patents and Trademarks*